US009689127B2

(12) United States Patent
Amani

(10) Patent No.: US 9,689,127 B2
(45) Date of Patent: Jun. 27, 2017

(54) SNOW MELTING ASSEMBLY

(71) Applicant: Mohammad Amani, Highwood, IL (US)

(72) Inventor: Mohammad Amani, Highwood, IL (US)

( * ) Notice: Subject to any disclaimer, the term of this patent is extended or adjusted under 35 U.S.C. 154(b) by 0 days.

(21) Appl. No.: 14/920,979

(22) Filed: Oct. 23, 2015

(65) Prior Publication Data

US 2017/0114511 A1 Apr. 27, 2017

(51) Int. Cl.
*E01H 5/10* (2006.01)

(52) U.S. Cl.
CPC ..... *E01H 5/102* (2013.01)

(58) Field of Classification Search
CPC ..... E01H 5/102; E01H 5/104; E01H 5/106; E01H 5/108
See application file for complete search history.

(56) References Cited

U.S. PATENT DOCUMENTS 553,401 A * 1/1896 Von Garnier ..... E01H 5/102 126/343.5 R
663,718 A * 12/1900 Beatty ..... E01H 5/102 126/343.5 R
734,195 A * 7/1903 Riedel ..... E01H 5/102 126/343.5 R
1,160,205 A * 11/1915 Smith ..... E01H 5/102 126/343.5 R
1,418,630 A * 6/1922 Crouse ..... E01H 5/102 126/343.5 R
2,576,829 A * 11/1951 Fiduccia ..... E01H 5/102 126/343.5 R
2,977,695 A * 4/1961 Kesecker ..... E01H 5/104 126/343.5 R
3,098,478 A * 7/1963 Philbrook ..... E01H 5/102 126/343.5 R
3,123,922 A * 3/1964 Spinelli ..... E01H 5/102 126/343.5 R
3,150,660 A * 9/1964 Gontcharuk ..... E01H 5/102 126/343.5 R
3,155,089 A * 11/1964 Hoyt ..... E01H 5/102 126/343.5 R
3,171,405 A * 3/1965 Miller ..... E01H 5/102 126/343.5 R
3,277,885 A * 10/1966 Gontcharuk ..... E01H 5/102 126/343.5 R
3,981,296 A * 9/1976 Medina ..... E01H 5/102 126/343.5 R
4,506,656 A * 3/1985 Baasch ..... E01H 5/00 126/343.5 R
4,615,129 A * 10/1986 Jackson ..... E01H 5/098 126/343.5 R (Continued)

*Primary Examiner* — Hau Phan
*Assistant Examiner* — Jacob Meyer

(57) ABSTRACT

A snow melting assembly includes a cart that may contain snow thereby facilitating the snow to be melted. A lid is hingedly coupled to the cart such that the lid is positionable between an open position and a closed position. An agitation unit is coupled to the cart such that the agitation unit may stir the snow within the cart. A heating unit is coupled to the cart such that the heating unit may melt the snow within the cart. A plurality of wheels is coupled to the cart such that the cart may be rolled along a support surface. A handle is movably coupled to the cart such that the handle may be manipulated.

19 Claims, 6 Drawing Sheets

(56) References Cited

U.S. PATENT DOCUMENTS 4,697,572 A * 10/1987 James ..... E01H 5/102 126/343.5 R
D317,042 S 5/1991 Hall
5,266,220 A * 11/1993 Hammond ..... E01H 5/102 126/343.5 R
5,718,221 A * 2/1998 Lobato ..... E01H 5/102 126/271.1
5,791,335 A * 8/1998 Luciani ..... E01H 5/102 126/343.5 R
5,804,799 A * 9/1998 Stewart ..... H05B 3/34 219/202
5,953,837 A * 9/1999 Clifford ..... E01H 5/104 126/343.5 R
6,971,596 B2 * 12/2005 Monroe ..... E01H 5/102 241/23
7,077,346 B2 * 7/2006 Monroe ..... E01H 5/102 241/86.1
7,201,385 B2 * 4/2007 Renz ..... B62B 3/02 280/47.34
7,841,512 B2 * 11/2010 Westerman ..... B65D 5/3678 229/117.01
7,958,656 B2 * 6/2011 Soderberg ..... E01H 5/102 37/226
8,428,446 B1 * 4/2013 Pimentel ..... E01H 5/106 392/379
8,640,687 B2 * 2/2014 Tucker ..... E01H 5/102 126/343.5 R
2002/0069560 A1 6/2002 Smith
2007/0006874 A1 * 1/2007 Potter ..... E01H 5/102 126/343.5 R
2007/0220781 A1 9/2007 Altizer et al.
2009/0282707 A1 * 11/2009 Shenouda ..... E01H 5/106 37/227
2012/0006804 A1 * 1/2012 Jenkins ..... E01H 5/106 219/202
2012/0258411 A1 10/2012 Anderson
2015/0275449 A1 * 10/2015 Sanchez ..... E01H 5/102 432/88
2016/0153159 A1 * 6/2016 Al Bizri ..... E01H 5/102 100/39

* cited by examiner

SNOW MELTING ASSEMBLY

BACKGROUND OF THE DISCLOSURE

Field of the Disclosure

The disclosure relates to melting devices and more particularly pertains to a new melting device for melting snow.

SUMMARY OF THE DISCLOSURE

An embodiment of the disclosure meets the needs presented above by generally comprising a cart that may contain snow thereby facilitating the snow to be melted. A lid is hingedly coupled to the cart such that the lid is positionable between an open position and a closed position. An agitation unit is coupled to the cart such that the agitation unit may stir the snow within the cart. A heating unit is coupled to the cart such that the heating unit may melt the snow within the cart. A plurality of wheels is coupled to the cart such that the cart may be rolled along a support surface. A handle is movably coupled to the cart such that the handle may be manipulated.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
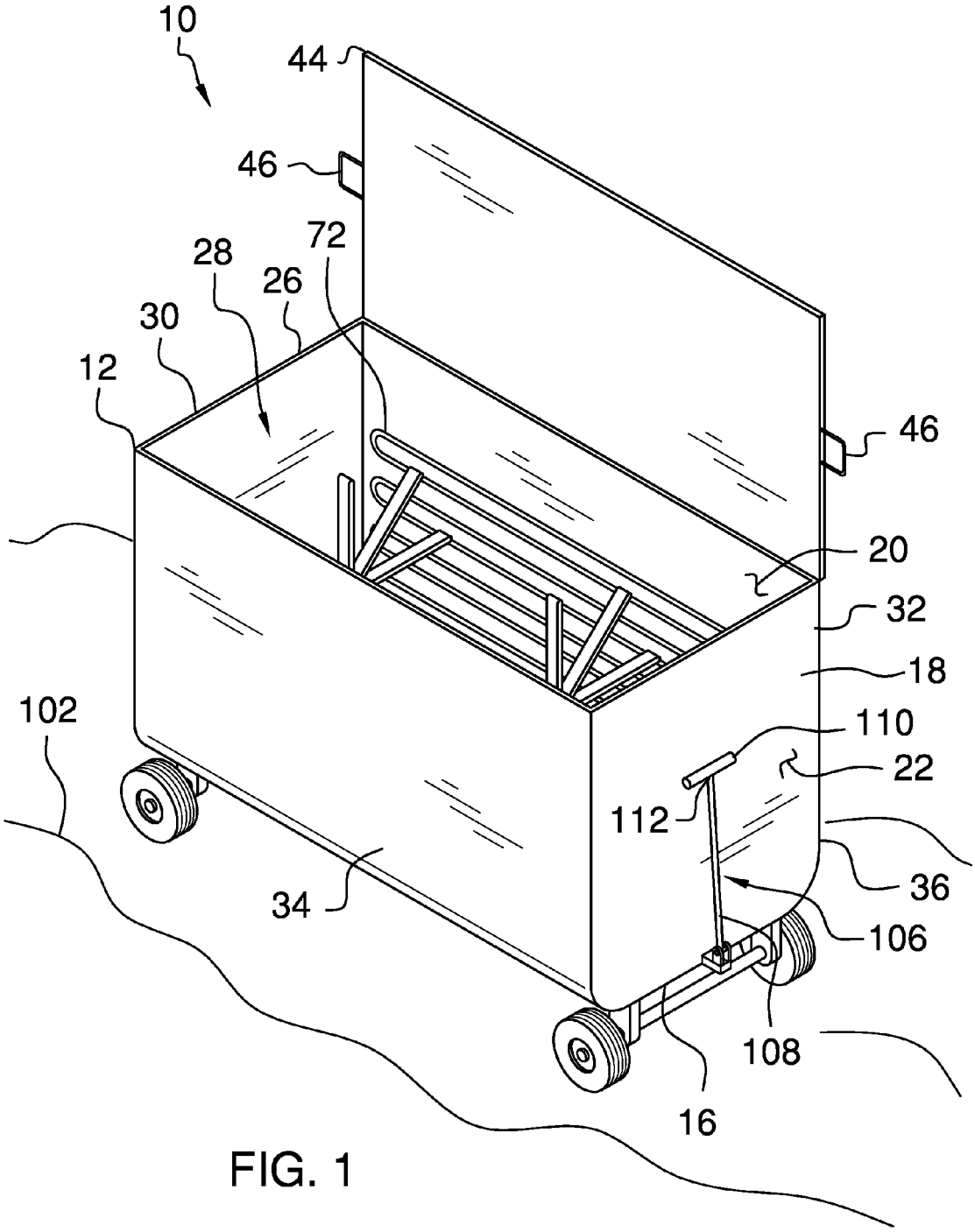
FIG. 1 is a top perspective view of a snow melting assembly according to an embodiment of the disclosure.
Figure 2:
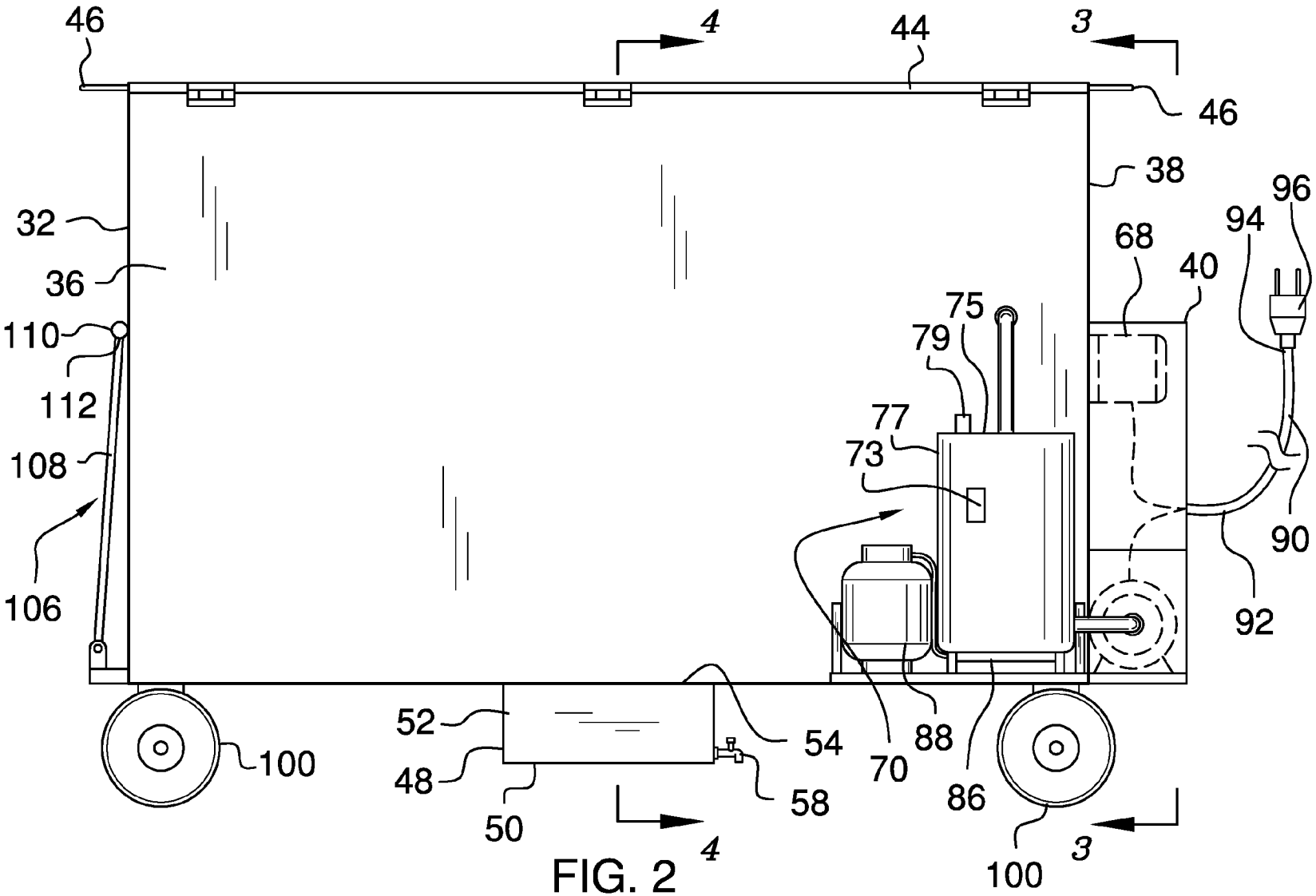
FIG. 2 is a back side view of an embodiment of the disclosure.
Figure 3:
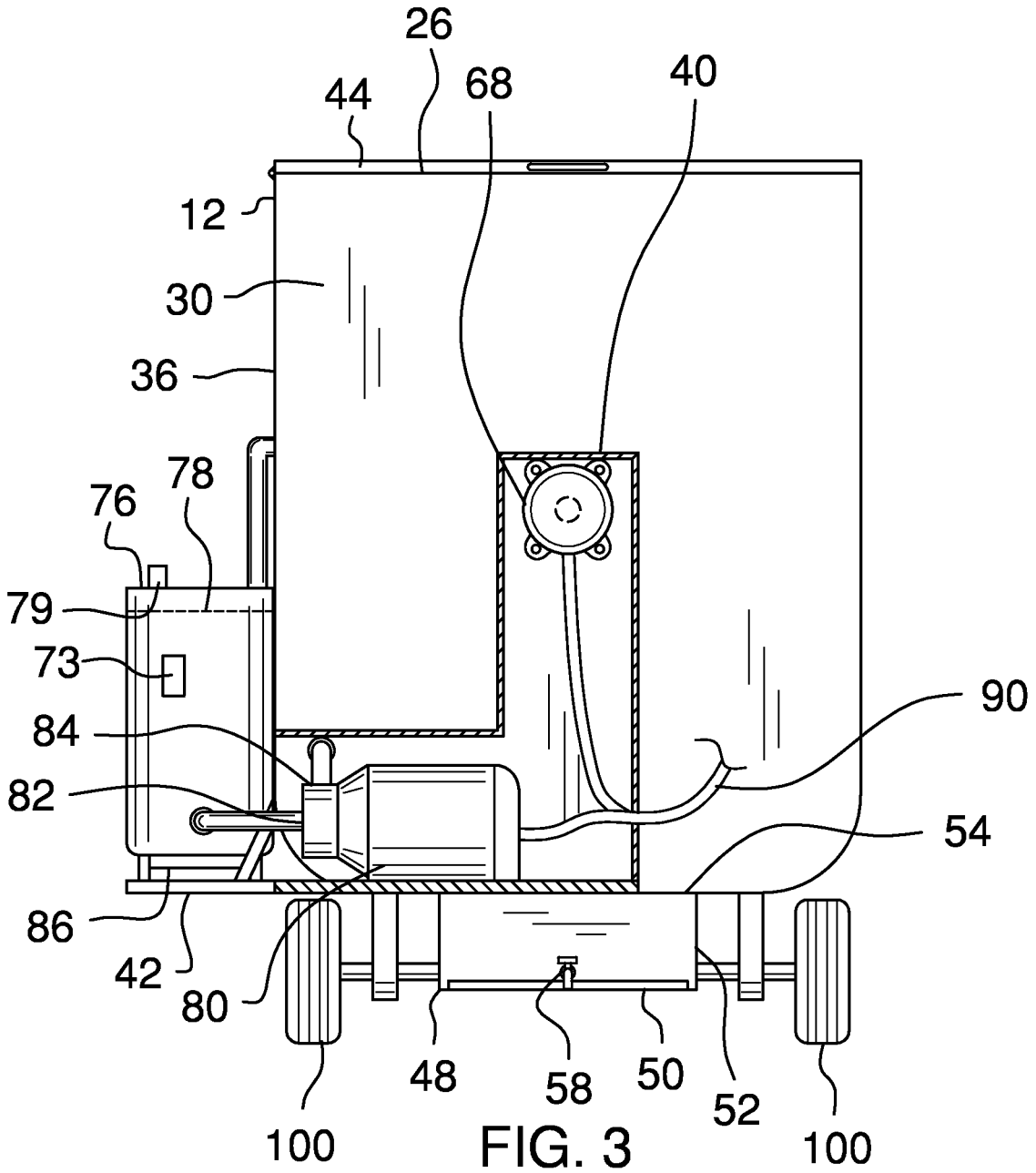
FIG. 3 is a cross sectional view taken along line 3-3 of FIG. 2 of an embodiment of the disclosure.
Figure 4:
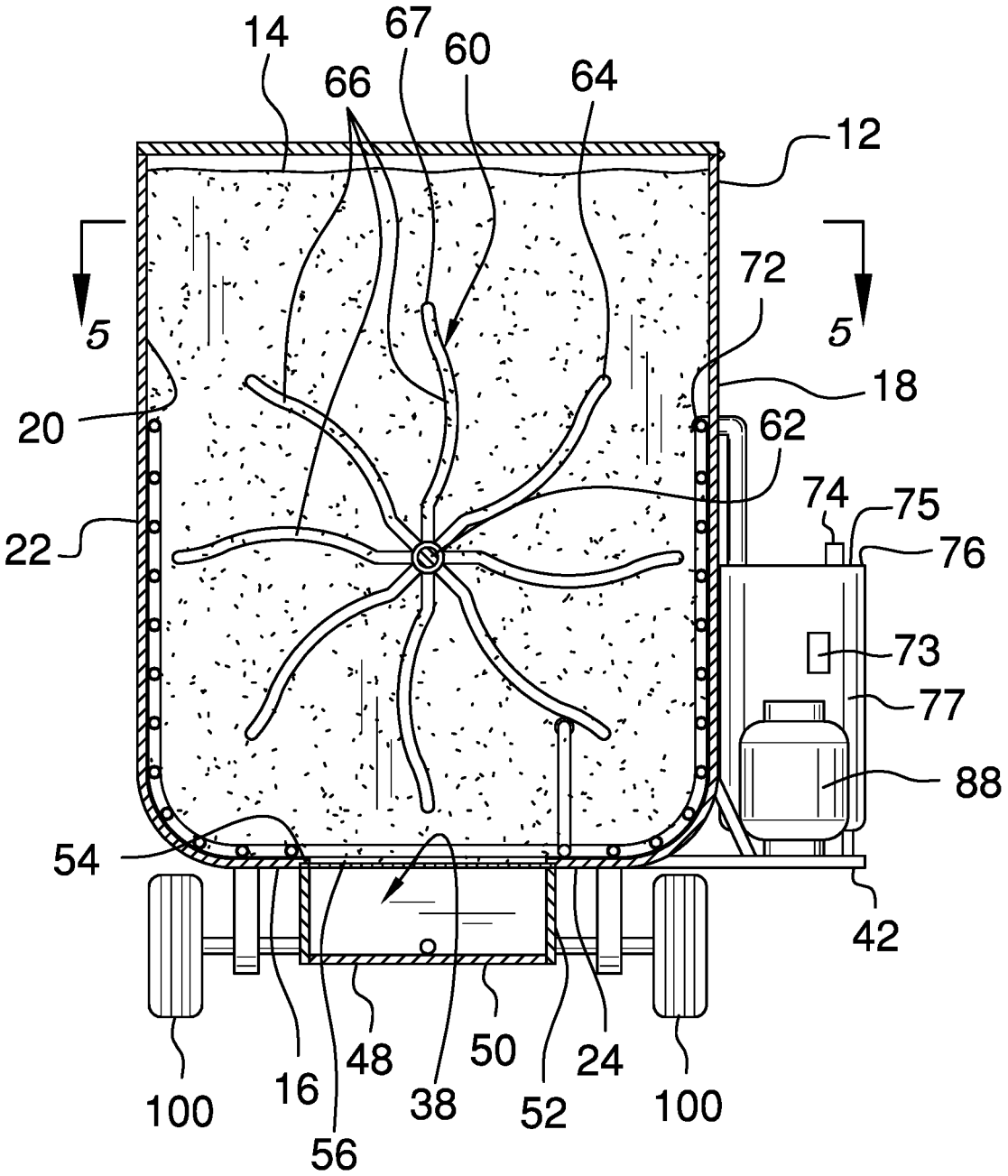
FIG. 4 is a cross sectional view taken along line 4-4 of FIG. 2 of an embodiment of the disclosure.
Figure 5:
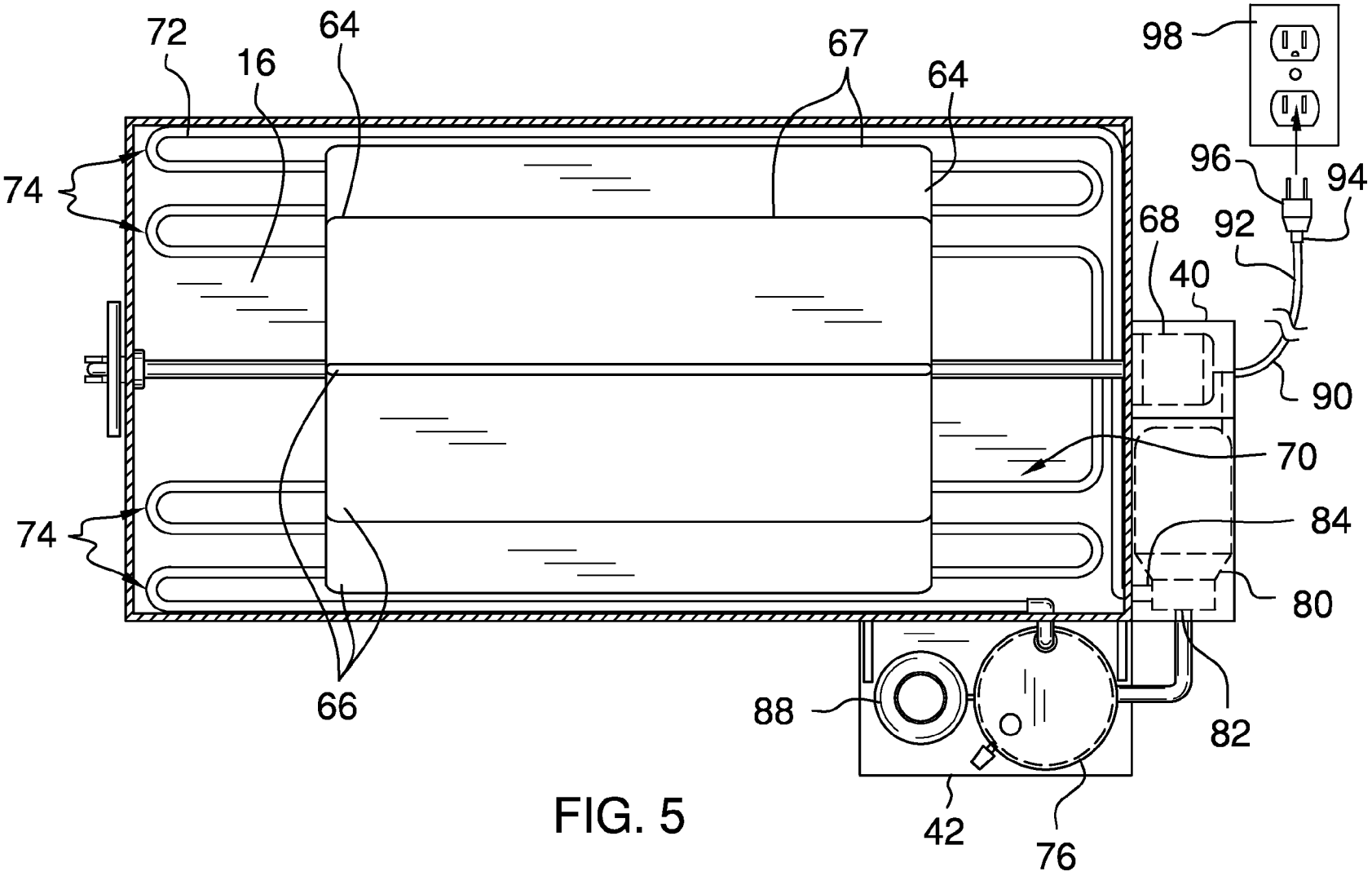
FIG. 5 is a cross sectional view taken along line 5-5 of FIG. 4 of an embodiment of the disclosure.
Figure 6:
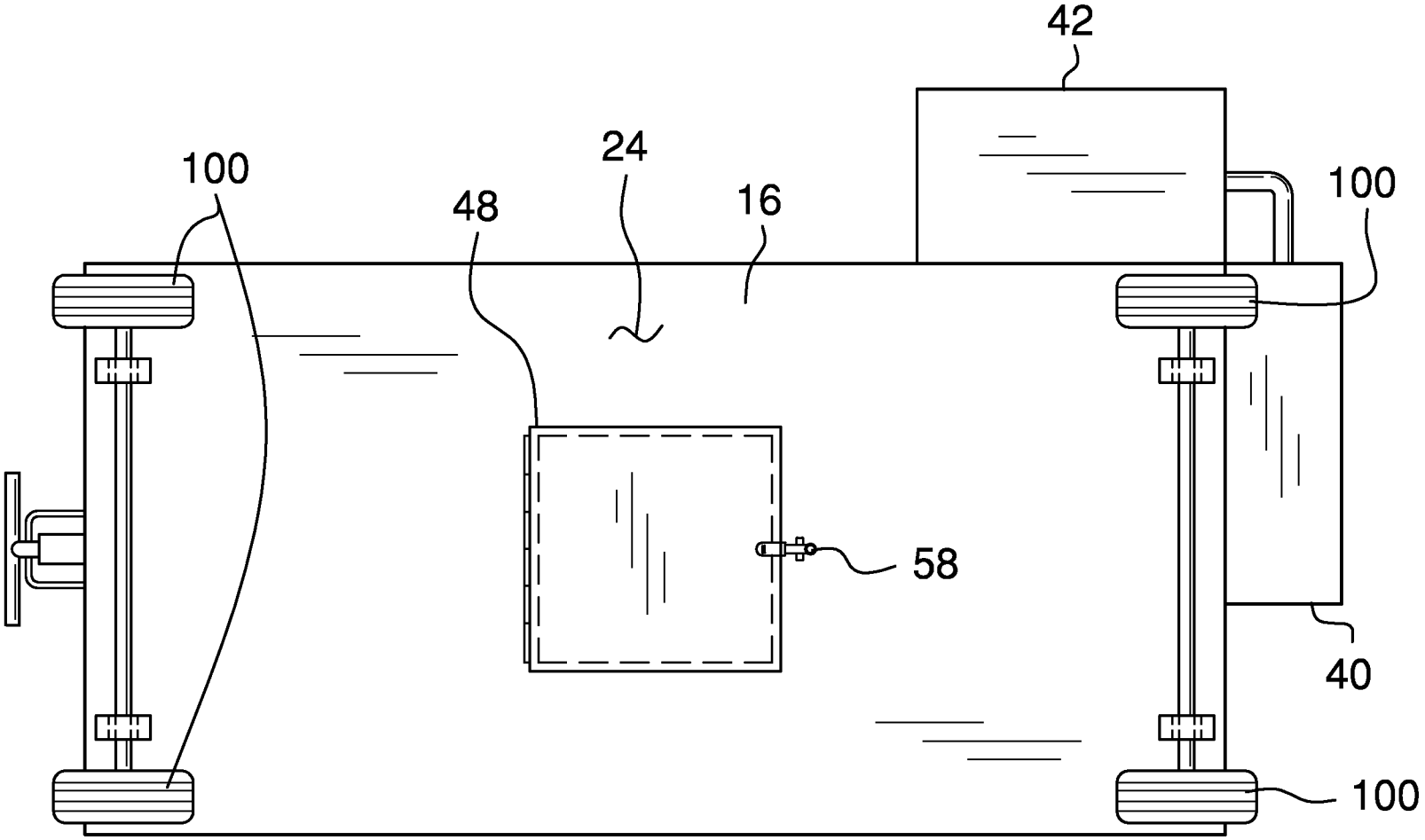
FIG. 6 is a bottom view of an embodiment of the disclosure.

With reference now to the drawings, and in particular to FIGS. 1 through 6 thereof, a new melting device embodying the principles and concepts of an embodiment of the disclosure and generally designated by the reference numeral 10 will be described.

As best illustrated in FIGS. 1 through 6, the snow melting assembly 10 generally comprises a cart 12 that may contain snow 14. The cart 12 has a bottom wall 16 and a peripheral wall 18 extending upwardly from the bottom wall 16. The peripheral wall 18 has an inner surface 20 and an outer surface 22. The peripheral wall 18 has a distal edge 26 with respect to the bottom wall 16 and the distal edge 26 forms an opening 28 into an interior of the cart 12. The peripheral wall 18 may curve outwardly between the bottom wall 16 and the distal edge 26.

The bottom wall 16 has a bottom surface 24. The peripheral wall 18 has a first lateral side 30, a second lateral side 32, a front side 34 and a back side 36. The bottom wall 16 has an opening 38 extending therethrough. The cart 12 is curved at an intersection between the first 30 and second 32 lateral sides and the bottom wall 16.

The cart 12 has a housing portion 40 that is positioned on the outer surface 22 corresponding to the first lateral side 30. The cart 12 has a shelf 42 that is coupled to and extends away from the back side 36. The shelf 42 is aligned with the bottom wall 16. A lid 44 is hingedly coupled to the cart 12 such that the lid 44 is positionable between an open position and a closed position. The lid 44 is hingedly coupled to the distal edge 26 corresponding to the back side 36. A pair of handles 46 is coupled to the lid 44 such that each of the handles 46 may be gripped. The handles 46 are positioned on opposite sides of the lid 44.

A box 48 is provided and the box 48 has a lower wall 50 and an outer wall extending 52 upwardly from the lower wall 50. The outer wall 52 has a distal edge 54 with respect to the lower wall 50. The distal edge 54 of the box 48 is attached to the bottom surface 24 of the bottom wall 16. The box 48 is aligned with the opening such that the box 48 may receive the melted snow 14. The lower wall 50 is hingedly coupled to the outer wall 52 such that the lower wall 52 is positionable between an open position and a closed position.

A screen 56 is coupled to the cart 12. The screen 56 is positioned on the bottom wall 16 such that the screen 56 completely covers the opening 38. The screen 56 prevents objects from entering the box 48. A drain 58 is coupled to the outer wall 52 of the box 48 such that the drain 58 may selectively release the melted snow 14 from the box 48. The drain 58 may comprise a spigot or the like.

An agitation unit 60 is coupled to the cart 12 such that the agitation unit 60 may stir the snow 14 within the cart 12. The agitation unit 60 comprises a shaft 62 extending through the first lateral side 30 and the second lateral side 32 of the cart 12. The shaft 62 is rotatably coupled to the cart 12. The shaft 62 is centrally positioned on the first lateral side 30 and the second lateral side 32.

A mixer 64 is provided and the mixer 64 is coupled to the shaft 62. The mixer 64 has a plurality of blades 66 radiating away from the shaft 62. The blades 66 are spaced apart from each other and distributed around the shaft 62. Each of the blades 66 has a distal edge 67 with respect to the shaft 62. Each of the blades 66 is curved between the shaft 62 and the respective distal edge 67. The blades 66 agitate the snow 14 within the cart 12 when the shaft 62 is rotated. A motor 68 is positioned within the housing portion 40. The motor 68 has the shaft 62 rotatably coupled thereto such that the motor 68 rotates the shaft 62 when the motor 68 is turned on. The motor 68 may comprise an electric motor or the like.

A heating unit 70 is coupled to the cart 12 and the heating unit 70 may melt the snow 14 within the cart 12. The heating unit 70 comprises a tube 72 that is coupled to the inner surface 20 of the peripheral wall 18 corresponding to the front side 34 and the back side 38. The tube 72 extends onto the bottom wall 16 and the tube 72 forms a plurality of loops 74. Each of the loops 74 extends between the first lateral side 30 and the second lateral side 32.

A fluid reservoir 76 is positioned on the shelf 42 and the fluid reservoir 76 may contain a fluid 78. The fluid 78 may comprise water and the tube 72 is fluidly coupled to the fluid reservoir 76. A pump 80 is positioned within the housing portion 40 and the pump 80 has an inlet 82 and an outlet 84. The inlet 82 is fluidly coupled to the fluid reservoir 76 such that the pump 80 may urge the fluid 78 outwardly from the fluid reservoir 76. The outlet 84 is fluidly coupled to the tube 72 such that the pump 80 may urge the fluid 78 through the tube 72 and into the fluid reservoir 76.

The fluid reservoir 76 has a top wall 75 and an exterior wall 77. A cap 79 is removably coupled to the top wall 75. The cap 75 is removed to facilitate the fluid reservoir 75 to be filled with the fluid. A pressure gauge 73 is coupled to the exterior wall 77. The pressure gauge 73 is in fluid communication with an interior of the fluid reservoir 76. Thus, the pressure gauge 73 indicates a pressure of the fluid within the fluid reservoir 76.

A burner 86 is coupled to the fluid reservoir 76 such that the burner 86 may heat the fluid 78 in the fluid reservoir 76. The tube 72 may be heated by the heated fluid 78 thereby facilitating the tube 72 to melt the snow 14. A fuel tank 88 is positioned on the shelf 42 and the fuel tank 88 may contain a fuel. The fuel tank 88 is fluidly coupled to the burner 86 such that the fuel tank 88 may supply the burner 86 with the fuel. The fuel may comprise liquid propane or the like.

A power supply 90 is coupled to the cart 12 and the power supply 90 is electrically coupled to the motor 68 and the pump 80. The power supply 90 comprises a cord 92 extending outwardly from the cart 12. The cord 92 has a distal end 94 with respect to the cart 12 and the distal end 94 has a plug 96 that is electrically coupled thereto. The plug 96 may be electrically coupled to a power source 98 and the power source 98 may comprise an electrical outlet, an extrinsic generator or other power source 98.

A plurality of wheels 100 is coupled to the cart 12 such that the cart 12 may be rolled along a support surface 102. Each of the wheels 100 is positioned on the bottom surface 24 of the bottom wall 16. Each of the wheels 100 is positioned adjacent to an associated one of four corners of the bottom wall 16. The support surface 102 may be ground.

A handle 106 is movably coupled to the cart 12 such that the handle 106 may be manipulated to urge the cart 12 along the support surface 102. The handle 106 has a rod 108 and a grip 110 and the rod 108 is hingedly coupled to the outer surface 22 corresponding to the second lateral side 32. The rod 108 has a distal end 112 with respect to the second lateral side 32. The grip 110 is attached to the distal end 112 of the rod 108 such that the grip 112 is oriented transversely to the rod 108. Thus, the grip 112 may be gripped.

In use, the cart 12 is filled with snow 14 and the lid 44 is positioned in the closed position. The power supply 90 is electrically coupled to the power source to actuate the pump 80 and the motor 68. The motor 68 rotates the shaft 62 and the mixers 64 agitate the snow 14 within the cart 12. The burner 86 is turned on to heat the fluid 78 in the fluid reservoir 76. The pump 80 urges the fluid 78 through the tube 72. The heat from the heated fluid 14 is transferred into the tube 72 thereby facilitating the tube 72 to melt the snow 14 within the cart 12. The drain 58 is manipulated to drain the cart 12 after all of the snow 14 has been melted.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A snow melting assembly comprising:

a cart being configured to contain snow thereby facilitating the snow to be melted, said cart having a distal edge and a back side;

a lid being hingedly coupled to said cart such that said lid is positionable between an open position and a closed position, said lid being hingedly coupled to said distal edge corresponding to said back side, said lid having a pair of handles being coupled to said lid wherein each of said handles is configured to be gripped, said handles being positioned on opposite sides of said lid;

an agitation unit being coupled to said cart wherein said agitation unit is configured to stir the snow within said cart;

a heating unit being coupled to said cart wherein said heating unit is configured to melt the snow within said cart;

a plurality of wheels being coupled to said cart wherein said cart is configured to be rolled along a support surface; and a handle being movably coupled to said cart wherein said handle is configured to be manipulated.

2. The assembly according to claim 1, wherein said cart has a bottom wall and a peripheral wall extending upwardly from said bottom wall, said peripheral wall having an inner surface and an outer surface, said bottom wall having a bottom surface, said peripheral wall having a distal edge with respect to said bottom wall, said distal edge forming an opening into an interior of said cart, said peripheral wall having a first lateral side, a second lateral side, a front side and a back side.

3. The assembly according to claim 2, wherein said bottom wall has an opening extending therethrough, said cart having a housing portion being positioned on said outer surface corresponding to said first lateral side, said cart having a shelf being coupled to and extending away from said back side, said shelf being aligned with said bottom wall.

4. The assembly according to claim 2, further comprising a box having a lower wall and an outer wall extending upwardly from said lower wall, said outer wall having a distal edge with respect to said lower wall, said distal edge of said box being attached to said bottom surface of said bottom wall such that said box is aligned with said opening wherein said box is configured to receive the melted snow.

5. The assembly according to claim 4, wherein said lower wall is hingedly coupled to said outer wall such that said lower wall is positionable between an open position and a closed position.

6. The assembly according to claim 3, further comprising a screen being coupled to said cart, said screen being positioned on said bottom wall such that said screen completely covers said opening.

7. The assembly according to claim 4, further comprising a drain being coupled to said outer wall of said box wherein said drain is configured to selectively release the melted snow from said box.

8. The assembly according to claim 1, wherein:

said cart has a first lateral side and a second lateral side; and said agitation unit comprises a shaft extending through said first lateral side and said second lateral side of said cart such that said shaft is rotatably coupled to said cart, said shaft being centrally positioned on said first lateral side and said second lateral side.

9. The assembly according to claim 8, further comprising:

a mixer, said mixer being coupled to said shaft, said mixer having a plurality of blades radiating away from said shaft wherein said blades are configured to agitate the snow within said cart when said shaft is rotated; and said blades being spaced apart from each other and being distributed around said shaft, each of said blades having a distal edge with respect to said shaft, each of said blades being curved between said shaft and said respective distal edge.

10. The assembly according to claim 9, further comprising:

said cart having a housing portion; and a motor being positioned within said housing portion, said motor having said shaft being rotatably coupled thereto such that said motor rotates said shaft when said motor is turned on.

11. The assembly according to claim 1, further comprising:

a motor;

a pump; and a power supply being coupled to said cart, said power supply being electrically coupled to said motor and said pump, said power supply comprising a cord extending outwardly from said cart, said power supply having a distal end with respect to said cart, said distal end having a plug being electrically coupled thereto, said plug being configured to be electrically coupled to a power source.

12. The assembly according to claim 2, wherein each of said wheels is positioned on said bottom surface of said bottom wall, each of said wheels being positioned adjacent to an associated one of four corners of said bottom wall.

13. The assembly according to claim 2, wherein said handle has a rod and a grip, said rod being hingedly coupled to said outer surface corresponding to said second lateral side, said rod having a distal end with respect to said second lateral side, said grip being attached to said distal end such that said grip is oriented transversely to said rod wherein said grip is configured to be gripped.

14. A snow melting assembly comprising:

a cart being configured to contain snow thereby facilitating the snow to be melted;

a lid being hingedly coupled to said cart such that said lid is positionable between an open position and a closed position;

an agitation unit being coupled to said cart wherein said agitation unit is configured to stir the snow within said cart;

a heating unit being coupled to said cart wherein said heating unit is configured to melt the snow within said cart;

a plurality of wheels being coupled to said cart wherein said cart is configured to be rolled along a support surface;

a handle being movably coupled to said cart wherein said handle is configured to be manipulated;

wherein said cart has a peripheral wall and a bottom wall, said peripheral wall having an inner surface, a front side, a back side, a first lateral side and a second lateral side; and wherein said heating unit comprises a tube being coupled to said inner surface of said peripheral wall corresponding to said front side and said back side, said tube extending onto said bottom wall, said tube forming a plurality of loops, each of said loops extending between said first lateral side and said second lateral side.

15. The assembly according to claim 14, further comprising:

a shelf; and a fluid reservoir being positioned on said shelf wherein said fluid reservoir is configured to contain a fluid, said tube being fluidly coupled to said fluid reservoir.

16. The assembly according to claim 15, further comprising:

said cart having a housing portion; and a pump being positioned within said housing portion, said pump having an inlet and an outlet, said inlet being fluidly coupled to said reservoir wherein said pump is configured to urge the fluid outwardly from said reservoir, said outlet being fluidly coupled to said tube wherein said pump is configured to urge the fluid through said tube and into said reservoir.

17. The assembly according to claim 15, further comprising a burner being coupled to said fluid reservoir wherein said burner is configured to heat the fluid in said reservoir, said tube being configured to be heated by the heated fluid thereby facilitating said tube to melt the snow.

18. The assembly according to claim 17, further comprising a fuel tank being positioned on said shelf wherein said fuel tank is configured to contain a fuel, said fuel tank being fluidly coupled to said burner wherein said fuel tank is configured to supply said burner with the fuel.

19. A snow melting assembly comprising:

a cart being configured to contain snow thereby facilitating the snow to be melted, said cart having a bottom wall and a peripheral wall extending upwardly from said bottom wall, said peripheral wall having an inner surface and an outer surface, said bottom wall having a bottom surface, said peripheral wall having a distal edge with respect to said bottom wall, said distal edge forming an opening into an interior of said cart, said peripheral wall having a first lateral side, a second lateral side, a front side and a back side, said bottom wall having an opening extending therethrough, said cart having a housing portion being positioned on said outer surface corresponding to said first lateral side, said cart having a shelf being coupled to and extending away from said back side, said shelf being aligned with said bottom wall;

a lid being hingedly coupled to said cart such that said lid is positionable between an open position and a closed position, said lid being hingedly coupled to said distal edge corresponding to said back side, said lid having a pair of handles being coupled to said lid wherein each of said handles is configured to be gripped, said handles being positioned on opposite sides of said lid;

a box having a lower wall and an outer wall extending upwardly from said lower wall, said outer wall having a distal edge with respect to said lower wall, said distal edge of said box being attached to said bottom surface of said bottom wall such that said box is aligned with said opening wherein said box is configured to receive the melted snow, said lower wall being hingedly coupled to said outer wall such that said lower wall is positionable between an open position and a closed position;

a screen being coupled to said cart, said screen being positioned on said bottom wall such that said screen completely covers said opening;

a drain being coupled to said outer wall of said box wherein said drain is configured to selectively release the melted snow from said box;

an agitation unit being coupled to said cart wherein said agitation unit is configured to stir the snow within said cart, said agitation unit comprising:

a shaft extending through said first lateral side and said second lateral side of said cart such that said shaft is rotatably coupled to said cart, said shaft being centrally positioned on said first lateral side and said second lateral side, a mixer being coupled to said shaft, said mixer having a plurality of blades radiating away from said shaft wherein said blades are configured to agitate the snow within said cart when said shaft is rotated, said blades being spaced apart from each other and being distributed around said shaft, each of said blades having a distal edge with respect to said shaft, each of said blades being curved between said shaft and said respective distal edge, and a motor being positioned within said housing portion, said motor having said shaft being rotatably coupled thereto such that said motor rotates said shaft when said motor is turned on;

a heating unit being coupled to said cart wherein said heating unit is configured to melt the snow within said cart, said heating unit comprising:

a tube being coupled to said inner surface of said peripheral wall corresponding to said front side and said back side, said tube extending onto said bottom wall, said tube forming a plurality of loops, each of said loops extending between said first lateral side and said second lateral side, a fluid reservoir being positioned on said shelf wherein said fluid reservoir is configured to contain a fluid, said tube being fluidly coupled to said fluid reservoir, a pump being positioned within said housing portion, said pump having an inlet and an outlet, said inlet being fluidly coupled to said reservoir wherein said pump is configured to urge the fluid outwardly from said reservoir, said outlet being fluidly coupled to said tube wherein said pump is configured to urge the fluid through said tube and into said reservoir, a burner being coupled to said fluid reservoir wherein said burner is configured to heat the fluid in said reservoir, said tube being configured to be heated by the heated fluid thereby facilitating said tube to melt the snow, a fuel tank being positioned on said shelf wherein said fuel tank is configured to contain a fuel, said fuel tank being fluidly coupled to said burner wherein said fuel tank is configured to supply said burner with the fuel, and a power supply being coupled to said cart, said power supply being electrically coupled to said motor and said pump, said power supply comprising a cord extending outwardly from said cart, said power supply having a distal end with respect to said cart, said distal end having a plug being electrically coupled thereto, said plug being configured to be electrically coupled to a power source;

a plurality of wheels being coupled to said cart wherein said cart is configured to be rolled along a support surface, each of said wheels being positioned on said bottom surface of said bottom wall, each of said wheels being positioned adjacent to an associated one of four corners of said bottom wall; and a handle being movably coupled to said cart wherein said handle is configured to be manipulated, said handle having a rod and a grip, said rod being hingedly coupled to said outer surface corresponding to said second lateral side, said rod having a distal end with respect to said second lateral side, said grip being attached to said distal end such that said grip is oriented transversely to said rod wherein said grip is configured to be gripped.

* * * * *